United States Patent [19]

Nusair et al.

[11] Patent Number: 4,973,925

[45] Date of Patent: Nov. 27, 1990

[54] DOUBLE-RIDGE WAVEGUIDE TO MICROSTRIP COUPLING

[75] Inventors: Marwan E. Nusair; Stephen R. Scholl; Michael D. Valentine, all of Cincinnati, Ohio

[73] Assignee: Valentine Research, Inc., Cincinnati, Ohio

[21] Appl. No.: 409,740

[22] Filed: Sep. 20, 1989

[51] Int. Cl.[5] ..... H01P 5/107

[52] U.S. Cl. ..... 333/26; 333/34

[58] Field of Search ..... 333/21 R, 26, 34

[56] References Cited

U.S. PATENT DOCUMENTS

| | | | |
|---|---|---|---|
| 2,825,876 | 3/1958 | Le Vine et al. . | |
| 3,188,583 | 6/1965 | Boyd | 333/26 |
| 3,969,691 | 7/1976 | Saul . | |
| 4,144,506 | 3/1979 | McCammon et al. | 333/26 |
| 4,453,142 | 6/1984 | Murphy . | |
| 4,550,296 | 10/1985 | Ehrlinger et al. . | |
| 4,562,416 | 12/1985 | Sedivec . | |
| 4,571,593 | 2/1986 | Martinson . | |
| 4,673,897 | 6/1987 | Chua et al. . | |
| 4,679,249 | 7/1987 | Tanaka et al. . | |
| 4,716,386 | 12/1987 | Lait . | |

FOREIGN PATENT DOCUMENTS

| | | | |
|---|---|---|---|
| 142802 | 6/1986 | Japan | 333/26 |

OTHER PUBLICATIONS

Jamal S. Izadian, "Unified Design Plans and Waveguide Transitions," Microwaves & RF, May, 1987.

James P. Montgomery, "On the Complete Eigenvalue Solution of Ridged Waveguide," Transitions on Microwave Theory and Techniques, vol. MTT-19, No. 6, Jun., 1971.

K. L. Walton & U. C. Sundberg, "Broadband Ridged Horn Design," Microwave J., vol. 7, pp. 96–101, Mar. 1964.

J. R. Pyle, "The Cutoff Wavelength of the $TE_{10}$ Mode in Ridged Rectangular Waveguide of Any Aspect Ratios," IEEE Transactions on Microwave Theory & Techniques, vol. MTT-14, No. 4, Apr., 1966.

*Primary Examiner*—Paul Gensler

*Attorney, Agent, or Firm*—Killworth, Gottman, Hagan & Schaeff

[57] ABSTRACT

A method and apparatus for coupling a double-ridge wavguide to a microstrip circuit. A lower ridge of a coupling section of waveguide is expanded by gradually increasing its width such that at the beginning of the coupling the lower ridge is equal to the width of the lower ridge of the double-ridge waveguide to be coupled and at the end of the coupling the width of the lower ridge is equal to the full width of the coupling. This flaring of the lower ridge creates an electrically conductive surface for receiving a ground plane for the microstrip circuit. Additionally, the upper ridge is altered gradually such that at the beginning of the coupling the ridge gap is equal to the gap in the double-ridge waveguide and at the end of the coupling the ridge gap is equal to the sum of the thicknesses of the dielectric substrate, the microstrip line, and the ground plane of the microstrip circuit. The upper ridge is gradually tapered over the length of the coupling and then sharply tapered adjacent the microstrip end of the coupling so that the width of the upper ridge is changed to the width of the microstrip line and the impedance of the coupling matches the impedance of the microstrip circuit. The sidewalls of the coupling may also be tapered inwardly or outwardly if needed for impedance matching.

7 Claims, 3 Drawing Sheets

DOUBLE-RIDGE WAVEGUIDE TO MICROSTRIP COUPLING

BACKGROUND OF THE INVENTION

The present invention relates generally to coupling various microwave propagating media and, more particularly, to a method and apparatus for coupling a double-ridge waveguide to a microstrip circuit.

Two of the most commonly employed microwave propagation media are waveguides and microstrip circuits. Usually, waveguides are hollow conductive conduits often having a rectangular or circular cross section intended to propagate microwaves between desired points with a minimum of loss. Waveguides often include ridged structures within the waveguides to change the propagation characteristics of the waveguides and adapt them for particular applications. Square, single-ridge, or double-ridge waveguides are preferred for use with various monitoring and test equipment or for long runs between physically separated parts of the system.

Microstrip circuits have a dielectric material separating a ground plane from a signal carrying microstrip line. Use of microstrip circuits is preferred in many design applications because their cost is negligible when compared to the much costlier waveguide "plumbing." Additionally, electrical components are easily coupled to microstrip. Finally, microstrip circuits are light weight and easily printed using conventional printed circuit board technology.

It is often desirable in microwave systems to employ different types of microwave propagating media including waveguide "plumbing" as the media in some parts of the system and microstrip circuits as the media in other parts of the system. Developing a unified circuit design thus requires efficient coupling between the different propagation media utilized in a given system.

It is well known in the art to couple square and single-ridge waveguides to microstrip circuits. Square waveguides are commonly coupled by adding a tapering ridge as disclosed in U.S. Pat. No. 3,969,691. Coupling a single-ridge waveguide to a microstrip circuit is closely parallel in that the ridge in a single-ridge waveguide is brought down towards the opposite wall, such that the gap is approximately the same thickness as the sum of the thickness of the dielectric, ground plane and microstrip line making up the microstrip circuit. Coupling is then obtained by simply inserting the microstrip circuit into the waveguide so that the ridge contacts the microstrip line and the flat opposing wall contacts the ground plane. In addition to a tapered ridge, other coupling approaches include tapered dielectrics, tapered waveguide walls, and combinations of these approaches, see for example for U.S. Pat. No. 2,825,876.

Double-ridge waveguides present a special problem in that they are inherently balanced transmission lines, whereas microstrip lines are inherently unbalanced transmission lines. Hence, it is desirable to develop a technique for coupling double-ridge waveguides to microstrip circuits for systems including both types of propagating media.

SUMMARY OF THE INVENTION

The present invention addresses the difficulty of coupling a double-ridge waveguide to a microstrip circuit and provides a method and apparatus for accomplishing such coupling with low losses. The objective in designing any microwave transition or coupling is to vary the impedance in such a way that mismatch, and hence reflection, does not occur. This requires that the boundary conditions on the electric and magnetic fields be observed at all times, and that the change in impedance along the coupling be gradual.

In accordance with these requirements, the upper and lower ridges of a section of double-ridge waveguide are modified to form the coupling with one end which matches a double-ridge waveguide and the other which matches a microstrip circuit. In particular, the upper ridge is downwardly tapered toward the microstrip end of the coupling while the lower ridge is expanded outwardly toward the sidewalls of the coupling, reaching the sidewalls at or near the microstrip coupling end. As the ridges are modified, the impedance smoothly and gradually change from a value corresponding to a double-ridge waveguide to a value corresponding to the microstrip circuit.

In accordance with one aspect of the present invention, a double-ridge waveguide to microstrip circuit coupling comprises a section of double-ridge waveguide having an upper ridge and a lower ridge with a ridge gap there between. The lower ridge is expanded in width to fill the waveguide section, thereby creating a surface for receiving the microstrip ground plane. The height of the upper ridge is gradually increased to a height such that the ridge gap is equal to the thickness of the microstrip structure. Additionally, the width of the upper waveguide is gradually reduced such that at or near the end of the microstrip end of the coupling, the impedance of the coupling is equal to the impedance of the microstrip.

The top, bottom, and side walls of the double-ridge waveguide to microstrip circuit coupling of the present invention may be unchanged throughout the coupling if an impedance match between the coupling and the microstrip line is achievable at the microstrip end of the coupling. However, if an impedance match cannot be achieved, the top, bottom, and side walls of the coupling may be tapered inwardly or outwardly such that the impedance of the microstrip end of the coupling is precisely equal to the impedance of the microstrip circuit.

The double-ridge waveguide end of the coupling is connected to a double-ridge waveguide in a conventional manner and the microstrip circuit is inserted into the microstrip end of the coupling such that the microstrip is in good electrical and physical contact with the modified upper ridge and the microstrip ground plane is in good electrical and physical contact with the expanded lower ridge which now forms the entire floor of the coupling. Thus the waveguide section is converted into a coupling having a microstrip circuit end and a double-ridge waveguide end.

In accordance with another aspect of the present invention, a method for achieving a double-ridge waveguide to microstrip circuit coupling comprises the steps of increasing the width of the lower ridge of a double-ridged waveguide section such that at the beginning of the coupling the lower ridge is equal to the width of the lower ridge of the double-ridge waveguide, and at the end of the coupling the width of the lower ridge is equal to the full width of the coupling. This flaring of the lower ridge to fill the coupling creates an electrically conducting surface for receiving the ground plane of the microstrip circuit. Gradually extending the upper ridge such that at the beginning of the coupling the ridge gap is equal to the gap in the double-ridge waveguide and at the end of the coupling the ridge gap is equal to the sum of the dielectric substrate thickness, the microstrip line thickness, and the ground plane material which make up the microstrip circuit. The upper ridge is also gradually tapered such that the width of the upper ridge at the beginning of the coupling is equal to the upper ridge width of the double ridge waveguide and at the end of the coupling the width of the upper ridge is such that the impedance of the waveguide is equal to the impedance of the microstrip line. The upper ridge is sharply tapered at the end of the coupling so that the width of the upper ridge rapidly changes to the width of the microstrip line. The impedance of the waveguide at the end of the coupling is calculated in the presence of the dielectric substrate since the microstrip circuit is inserted into the coupling such that the microstrip line is in good electrical and physical contact with the upper ridge, and the ground plane of the microstrip circuit is in good electrical and physical contact with the lower ridge, which now forms the entire floor of the coupling.

It is an object of the present invention to provide a method and apparatus for coupling a double-ridge waveguide to a microstrip circuit to facilitate the transition from double-ridge waveguide to microstrip circuit in microwave applications; to provide a method and apparatus for achieving a double-ridge waveguide to microstrip circuit coupling with low loss; to provide a method and apparatus for coupling a double-ridge waveguide to a microstrip circuit by modifying the upper ridge of a waveguide section to expand it in height toward the lower ridge and to taper it until it is substantially equal in width to the microstrip line of the microstrip circuit and the lower ridge of the waveguide section to expand it in width to fill the waveguide section for receiving the ground plane of the microstrip circuit.

Other objects and advantages of the invention will be apparent from the following description, the accompanying drawings, and the appended claims.

DETAILED DESCRIPTION OF THE INVENTION

Figure 1A:
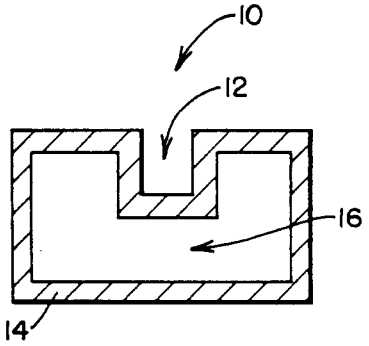
FIG. 1A is a cross sectional view of a single-ridge waveguide.
Figure 1B:
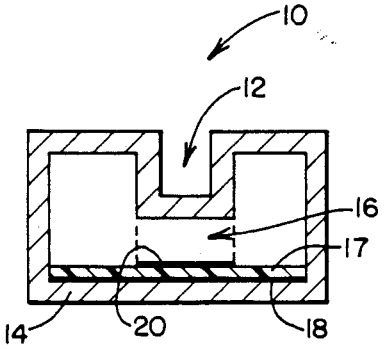
FIG. 1B is a cross sectional view of the single-ridge waveguide of FIG. 1 modified to receive and couple to a microstrip circuit.

Referring now to the drawings and, more particularly to FIG. 1A, which is a sectional view of a single-ridge waveguide 10. If a ridge 12 in the single-ridge waveguide 10 is brought down or extended toward a bottom wall 14 of the waveguide 10 such that the ridge gap 16 is approximately the same thickness as a microstrip circuit, i.e., the sum of the thicknesses of a dielectric substrate 17, a ground plane 18, and a microstrip line 20, then a good transition can be obtained by simply inserting the microstrip circuit into the waveguide 10 as shown in FIG. 1B. The ridge 12 then contacts the microstrip line 20 and the flat opposing bottom wall 14 contacts the ground plane 18.

Figure 2A:
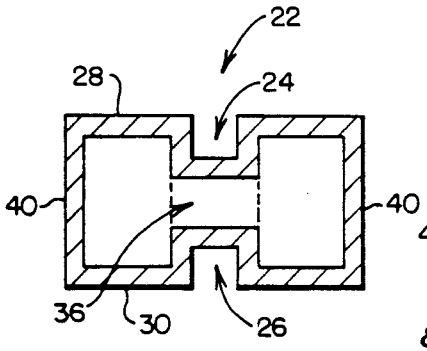
FIGS. 2A and 2B are cross sectional views of a double-ridge waveguide, showing the differences between the original double-ridge waveguide and the double-ridge waveguide to microstrip coupling of the present invention, respectively.

A double-ridge waveguide 22 is shown in FIG. 2A, having an upper ridge 24 and a lower ridge 26.

While, it is not readily apparent how the double-ridge waveguide 22 can be coupled to a flat microstrip-circuit, the present invention performs this coupling by altering the widths of the upper ridge 24 and the lower ridge 26 and the height of the upper ridge 24 of a section of double-ridge waveguide.

Figure 2B:
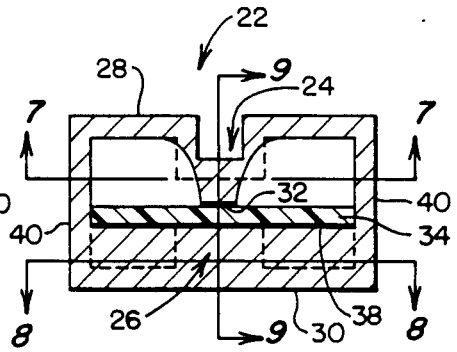

The desired impedance of the microstrip line 32 and the electrical characteristics of the dielectric substrate 34 and its thickness, uniquely determine the width of the microstrip line 32, see FIG. 2B. The upper ridge 24 of the double-ridge waveguide 22 of FIG. 2A is gradually altered so that at the beginning or double ridge waveguide end of the coupling, the ridge gap (i.e., the distance between upper ridge 24 and lower ridge 26) is equal to the ridge gap 36 shown in FIG. 2A, and at the microstrip circuit end of the coupling, the ridge gap 36 is equal to the sum of the thicknesses of the dielectric substrate 34, the microstrip line 32, and the ground plane 38, as shown in FIG. 2B.

The invention comprises expanding the lower ridge 26 so that the width of the lower ridge 26 gradually increases to entirely fill the coupling. At the beginning or waveguide end of the coupling, the lower ridge of the coupling is equal to the lower ridge 26 of the double-ridge waveguide 22 shown in FIG. 2A, and at the microstrip end of the coupling it expands to equal the full width of the coupling as in FIG. 2B. Additionally, the upper ridge 24 is tapered so that its width gradually narrows, such that at the beginning or waveguide end of the coupling it is equal to the upper ridge 24 shown in FIG. 2A, and at the microstrip end of the coupling, the upper ridge 24 width is such that the impedance of the coupling equals the impedance of the microstrip circuit. If this desired impedance is not otherwise achievable, the top wall 28, bottom wall 30, and side walls 40 may be tapered inwardly or outwardly to achieve the desired impedance at the microstrip end of the coupling.

Figure 7:
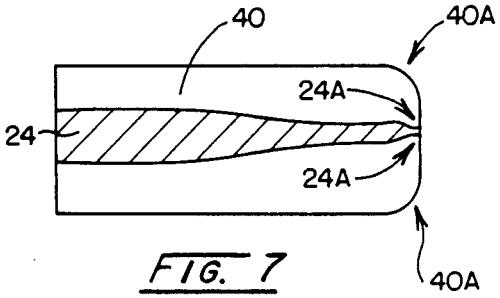
FIG. 7 is a sectional view of one embodiment of the present invention showing the inward transition of the upper ridge of the coupling taken along section line 7—7 shown in FIG. 2B.
Figure 8:
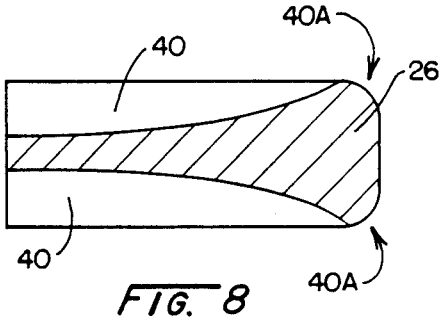
FIG. 8 is a sectional view of the embodiment of FIG. 7 showing the outward transition of the, lower ridge of the coupling taken along section line 8—8 shown in FIG. 2B.

In the final stage of the coupling the upper ridge 24 is tapered sharply as best shown in FIG. 7 to the width of the microstrip line 32. The impedance of the coupling at this point is calculated with the dielectric substrate 34 in the waveguide 22. The microstrip line 32 is the same width as the upper ridge 24 and is in good electrical and physical contact with the upper ridge 24, while the ground plane 38 is in good electrical and physical contact with the lower ridge 26 which now forms the entire floor of the coupling as shown in FIGS. 2B and 8. If, as is generally the case, this impedance is less than the impedance of the microstrip line 32, then the side walls 40 are sharply tapered as shown in FIGS. 7 and 8 so that the entire width of the waveguide 22 changes until the impedance is equal to the impedance of the microstrip line 32.

Figure 3:
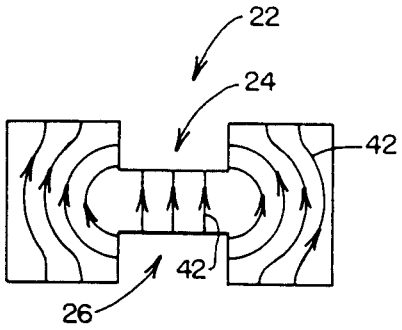
FIG. 3 shows the electric field orientation of the coupling at the double-ridge waveguide end of the coupling.

The objective in designing any microwave transition or coupling is to vary the impedance in such a way that mismatch, and hence reflection, does not occur. This requires that the boundary conditions on the electric and magnetic fields be observed at all times, and that the change in impedance along the coupling be gradual. In the present invention, the electric fields in the dominant hybrid mode are essentially vertical, as shown by lines 42 in FIG. 3, at the entrance or waveguide end of the coupling whereas the upper ridge 24 and the lower ridge 26 still maintain the original ridge widths and heights of the double-ridge waveguide 22.

Figure 4:
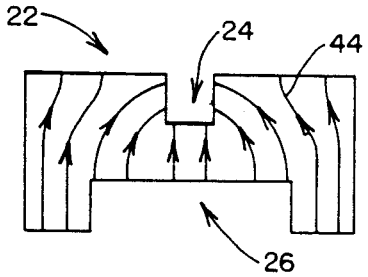
FIG. 4 shows the electric field orientation of the coupling at an intermediate point within the coupling.

At an intermediate point in the coupling, the fields acquire the general character shown by lines 44 in FIG. 4. In FIG. 4, noticeable effects of the coupling are seen. For instance, the width of the upper ridge 24 is tapering to adjust to the width of the microstrip line 32. Additionally, the height of the upper ridge 24 is gradually increasing as the lower ridge 26 expands to fill and create a wide floor for the coupling thereby beginning to create an electrically conducting surface for receiving the microstrip ground plane 38.

Figure 5:
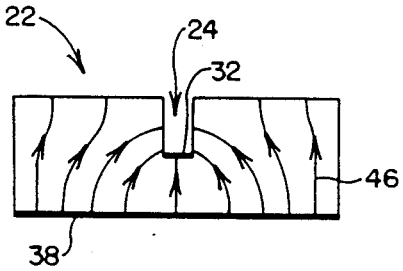
FIG. 5 shows the electric field orientation of the double-ridge waveguide toward the microstrip circuit end of the coupling.
Figure 6:
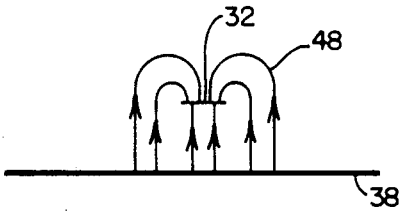
FIG. 6 shows the electric field distribution required for coupling to a microstrip circuit.

Near the microstrip end of the coupling, the fields take on the character shown by the lines 46 in FIG. 5, which are similar to the fields of a single-ridge waveguide. The rapid taper from that point to the microstrip line coupling represents a continuous concentration of the fields towards the center of the structure. FIG. 6 shows the final field configuration of the coupling wherein the upper ridge 24 width has been compressed until its width is equal to the width of the microstrip line 32. Also, the lower ridge 26 width has expanded to the point where it has become a flat plane, thereby becoming the floor of the coupling for receiving the bottom ground plane 38 of the microstrip circuit. It is when the fields are as shown by lines 48 in FIG. 6, that the coupling to a microstrip circuit can occur.

During these transitions in the coupling, the impedance has smoothly and gradually changed from that of a double-ridge waveguide to its end value corresponding to the microstrip circuit. During the rapid taper of the illustrated embodiment of the coupling, the impedance remains unchanged, due to the fact that both the coupling width and the upper ridge width are reduced, while a dielectric is introduced into the coupling. The reduction of the waveguide width and the upper ridge width values tends to increase the impedance, while the introduction of the dielectric tends to lower the impedance. These two effects are made to cancel, and the rapid taper ensures that any small discontinuities at the start of the dielectric are spatially tiny and may be ignored at the frequencies of interest.

Referring now to FIGS. 7 and 8, the side walls 40 of the double-ridge waveguide 22 are tapered at 40A and the dielectric substrate 34 of the microstrip circuit is placed within the microstrip end of the coupling in order to match the coupling impedance to the microstrip circuit impedance. In FIG. 7, a cross sectional view of the upper ridge 24 taken along line 7—7 in FIG. 2B is shown, to illustrate how the upper ridge 24 is sharply tapered at 24A to match its width and impedance to that of the microstrip line 32.

FIG. 8 shows a corresponding sectional view of the lower ridge 26 taken along section line 8—8 of FIG. 2B. FIG. 8 illustrates the expansion of the lower ridge 26 to fill the coupling, thereby creating an electrically conductive surface for receiving the microstrip ground plane 38.

Figure 9:
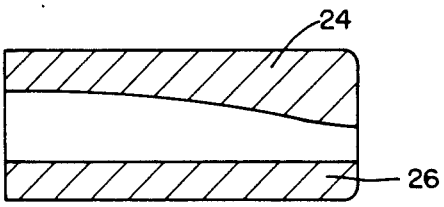
FIG. 9 is a sectional side view of the embodiment of FIG. 7 showing the height transition of the upper ridge of the coupling taken along section line 9—9 shown in FIG. 2B.

FIG. 9 shows a sectional view of the coupling taken along section line 9—9 of FIG. 2B to show the gradual height expansion of the upper ridge 24. When the coupling commences, it matches the double-ridge waveguide 22 as denoted by the dotted lines in FIG. 2B; whereas when the coupling terminates in the microstrip circuit, it will have the shape denoted by the solid lines in FIG. 2B.

Having described the invention in detail and by reference to preferred embodiments thereof, it will be apparent that modifications and variations are possible without departing from the scope of the invention which is defined in the appended claims.

What is claimed is:

1. A method for forming a double-ridge waveguide to microstrip circuit coupling wherein both the waveguide and the microstrip have electric fields, magnetic fields and impedances, the double-ridge waveguide having top, bottom, and side walls with an upper ridge projecting centrally from the top wall and a lower ridge projecting centrally from the bottom wall and a ridge gap extending between the upper ridge and the lower ridge, the microstrip having a dielectric substrate with a microstrip line on one side and a ground plane on the other side, the method comprising:

gradually expanding the lower ridge to create a wide floor for filling a microstrip coupling end of the coupling;

gradually increasing the height of the upper ridge of the coupling to a height such that the ridge gap is equal to the thickness of the microstrip circuit;

gradually reducing the width of the upper ridge such that at the end of the microstrip end of the coupling, the width of the upper ridge is such that the impedance of the coupling is equal to the impedance of the microstrip circuit;

inserting the microstrip circuit into the microstrip end of the coupling to interconnect the coupling and the microstrip circuit such that the microstrip line of the microstrip circuit is in good electrical and physical contact with the modified upper ridge of the coupling and the microstrip ground plane is in good electrical and physical contact with the expanded lower ridge which forms the entire floor of the waveguide at the microstrip coupling end; and modifying the upper and lower ridges of the waveguide such that the boundary conditions of the electric and magnetic fields are continuous at all locations along the ridges and the impedance is smoothly and gradually changed to match the microstrip at the microstrip end of the coupling and the double-ridge waveguide at the end opposite thereto.

2. A method for forming a double-ridge waveguide to a microstrip circuit coupling as claimed in claim 1 wherein the side walls of the double-ridge waveguide are tapered inwardly or outwardly to match the coupling impedance to the impedance of the microstrip circuit.

3. A method for forming a double-ridge waveguide to a microstrip circuit coupling as claimed in claim 1 wherein the upper ridge and the side walls are sharply tapered at the microstrip end of the coupling to match the impedance of the coupling to the impedance of the microstrip circuit.

4. A method for forming a double-ridge waveguide to a microstrip circuit coupling wherein both the waveguide and the microstrip have impedances, the double-ridge waveguide having top, bottom, and side walls with an upper ridge projecting centrally from the top wall and a lower ridge projecting centrally from the bottom wall and a ridge gap between the upper ridge and the lower ridge, the microstrip having a dielectric substrate with a microstrip line on one side and a ground plane on the other side, the method comprising:

determining the microstrip line width using the desired impedance of the microstrip line and dielectric characteristics of specification of the dielectric substrate;

gradually expanding the width of the lower ridge such that at the waveguide end of the coupling the lower ridge is equal to the width of the lower ridge of the waveguide, and at the microstrip end of the coupling the width of the lower ridge is equal to the full width of the coupling;

gradually altering the upper ridge of the coupling such that at the waveguide end of the coupling the ridge gap is equal to the gap in the double-ridge waveguide and at the microstrip end of the coupling the ridge gap is equal to sum of the dielectric substrate thickness, the microstrip line thickness, and the ground plane thickness;

gradually tapering the upper ridge such that the width of the upper ridge at the beginning of the coupling is equal to the upper ridge width of the double-ridge waveguide and at the microstrip end of the coupling the width of the upper ridge is such that the impedance of the waveguide equals the impedance of the microstrip line;

sharply tapering the upper ridge at the end of the coupling so that the width of the upper ridge rapidly changes to the width of the microstrip line; and placing the microstrip circuit within the microstrip end of the coupling, such that the microstrip line of the microstrip circuit is in good electrical and physical contact with the upper ridge and the ground plane of the microstrip circuit is in good electrical and physical contact with the lower ridge, which now forms the entire floor of the coupling.

5. A double-ridge waveguide to microstrip circuit coupling comprising:

top, bottom, and side walls with an upper ridge projecting centrally from the top wall and a lower ridge projecting centrally from the bottom wall and a ridge gap between the upper ridge and the lower ridge, a waveguide end of said coupling conforming to a double-ridge waveguide to be coupled;

said lower ridge gradually expanding toward a microstrip end of said coupling to create a full width floor for filling the microstrip end of said coupling;

the height of said upper ridge of said coupling gradually increasing to a height such that the ridge gap is equal to the thickness of a microstrip circuit to be coupled;

the width of said upper ridge gradually reducing such that at the end of the microstrip end of said coupling, the width of the upper ridge is such that the impedance of the coupling is equal to the impedance of the microstrip circuit; and the microstrip circuit being inserted into the microstrip end of said coupling such that the microstrip line of the microstrip circuit is in good electrical and physical contact with the modified upper ridge and the microstrip ground plane is in good electrical and physical contact with the expanded lower ridge which forms the entire floor of the coupling at the microstrip end.

6. A double-ridge waveguide to a microstrip circuit coupling as claimed in claim 5 wherein the upper ridge of the coupling is sharply tapered adjacent the microstrip end of said coupling to match the coupling impedance to the impedance of the microstrip circuit.

7. A double-ridge waveguide to a microstrip circuit coupling as claimed in claim 6 wherein the side walls are sharply tapered at the microstrip end of the coupling to match the impedance of the coupling to the impedance of the microstrip circuit.

* * * * *